US005732977A

United States Patent [19]

Kohana

[11] Patent Number: 5,732,977

[45] Date of Patent: Mar. 31, 1998

[54] CARD FILING DEVICE

[75] Inventor: Norio Kohana, Tokyo, Japan

[73] Assignee: Tops Co., Ltd., Tokyo, Japan

[21] Appl. No.: 751,260

[22] Filed: Nov. 18, 1996

[30] Foreign Application Priority Data

Nov. 22, 1995 [JP] Japan ..... 7-013372 U

[51] Int. Cl.[6] ..... B42D 3/00

[52] U.S. Cl. ..... 281/45; 281/29; 281/31; 281/38; 402/79

[58] Field of Search ..... 281/15.1, 29, 31, 281/38, 45, 51; 402/70, 73, 79; 40/124.1

[56] References Cited

FOREIGN PATENT DOCUMENTS

| | | |
|---|---|---|
| 4881915 | 12/1946 | Japan . |
| 49115011 | 1/1948 | Japan . |
| 49145717 | 4/1948 | Japan . |
| 552699 | 3/1954 | Japan . |

*Primary Examiner*—Willmon Fridie, Jr.
*Attorney, Agent, or Firm*—Jacox, Meckstroth & Jenkins

[57] ABSTRACT

A card filing device for filing a plurality of cards, which is inexpensive, easy to assemble, suited to mass production, exceptionally versatile, capable of being easily stored in storage cases or wallets, and easy to handle, having a simple and compact structure which allows the stored cards to be easily identified and allows the selected cards to be simply and quickly removed. The invention comprises a plurality of card cases B each having a card storage pocket 10 which can hold various types of cards, and a plurality of attachment leaves 4 to which respective card cases B are slidably attached. Each card case B is provided with a protruding tab portion 11 which is capable of being grasped and pulled by the fingers. In this manner, when a selected card case B is slid out with respect to the corresponding attachment leaf 4 of the holder A, then the selected card case B is made to protrude farther than the other card cases. This then allows the selected card to be easily removed.

6 Claims, 5 Drawing Sheets

10
B
B1
11
14
13
5
4
3
2
2
A
1
24
23
21
C
20
22

CARD FILING DEVICE

BACKGROUND OF THE INVENTION

1. Technical Field of the Invention

The present invention relates to card filing devices which are capable of filing a plurality of various types of cards, such as credit cards, cash cards, telephone cards, other types of debit cards, and ID cards, while allowing the cards to be quickly and easily retrieved.

2. Background Art

Conventionally, most of the devices offered for storing a plurality of cards such as credit cards or cash cards have been of the type wherein a plurality of pockets are provided in a vertically stepped fashion (multi-layered), and the cards are stored in the pockets with a portion of each card exposed to allow identification of the card.

However, when the cards are stored in this type of multi-layered fashion with a portion of each exposed, the area of overlap between the pockets must be increased in order to allow more cards to be stored. Therefore, it becomes difficult to keep the structure compact, and the removal of cards from the pockets can be troublesome.

SUMMARY OF THE INVENTION

The object of the present invention is to resolve the above-mentioned problems by presenting a card filing device having a compact, simple structure, which is easy to handle, extremely versatile, and capable of being offered at a low cost.

In order to achieve this object, the present invention offers a card filing device comprising a plurality of card cases each having a card storage pocket for storing cards and a tab portion which protrudes to allow grasping by a user's fingers; and a holder having a plurality of attachment leaves to which the plurality of card cases are respectively attached such as to be capable of sliding in a predetermined direction; wherein any desired card case can be pulled out to protrude further than the other card cases by sliding the desired card case with respect to the corresponding attachment leaf of the holder, so as to allow a card inside the card case to be easily removed.

PREFERRED EMBODIMENTS OF THE INVENTION

Figure 1:
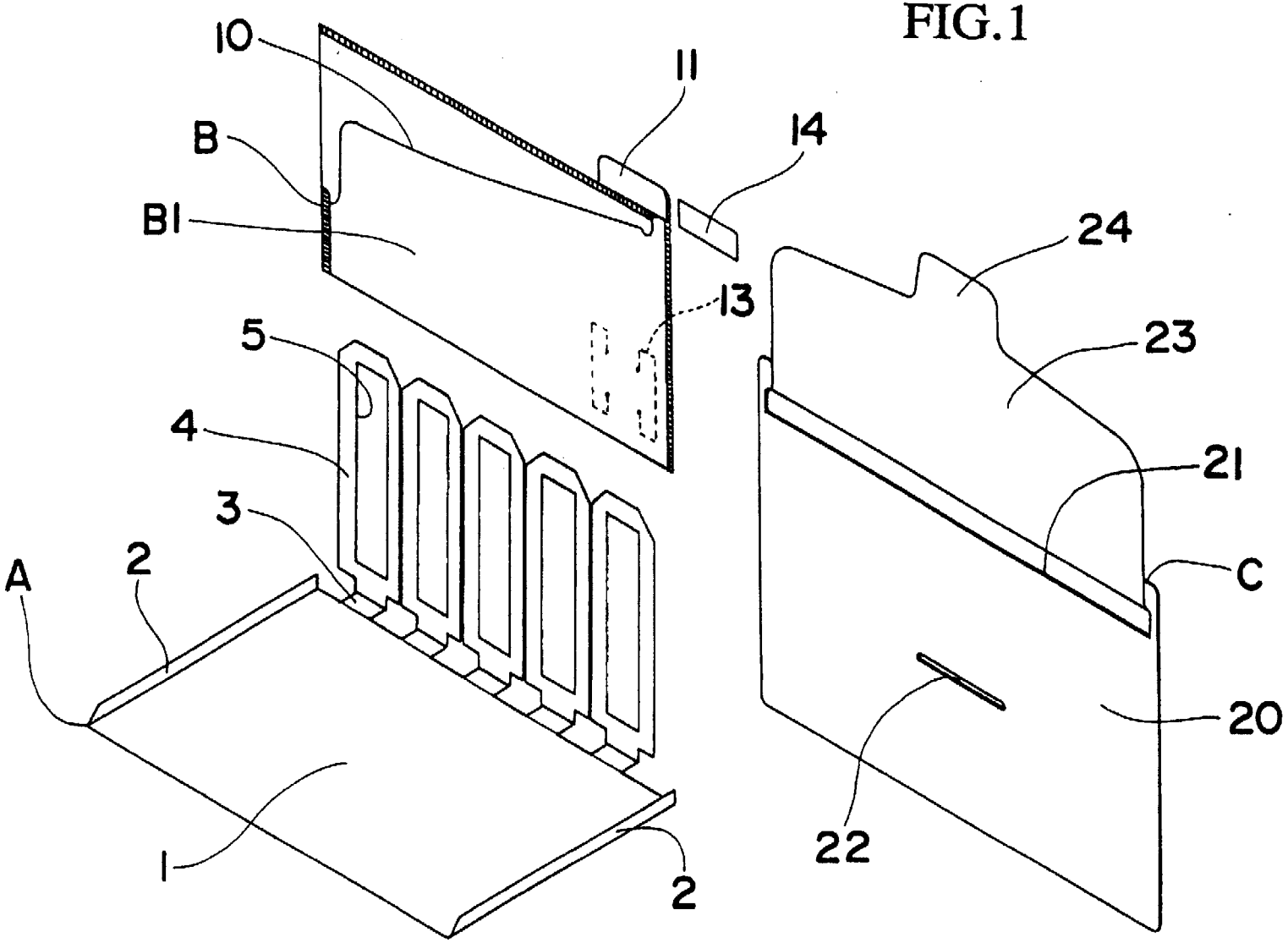
FIG. 1 is an exploded perspective view showing an embodiment of a card filing device according to the present invention.
Figure 2:
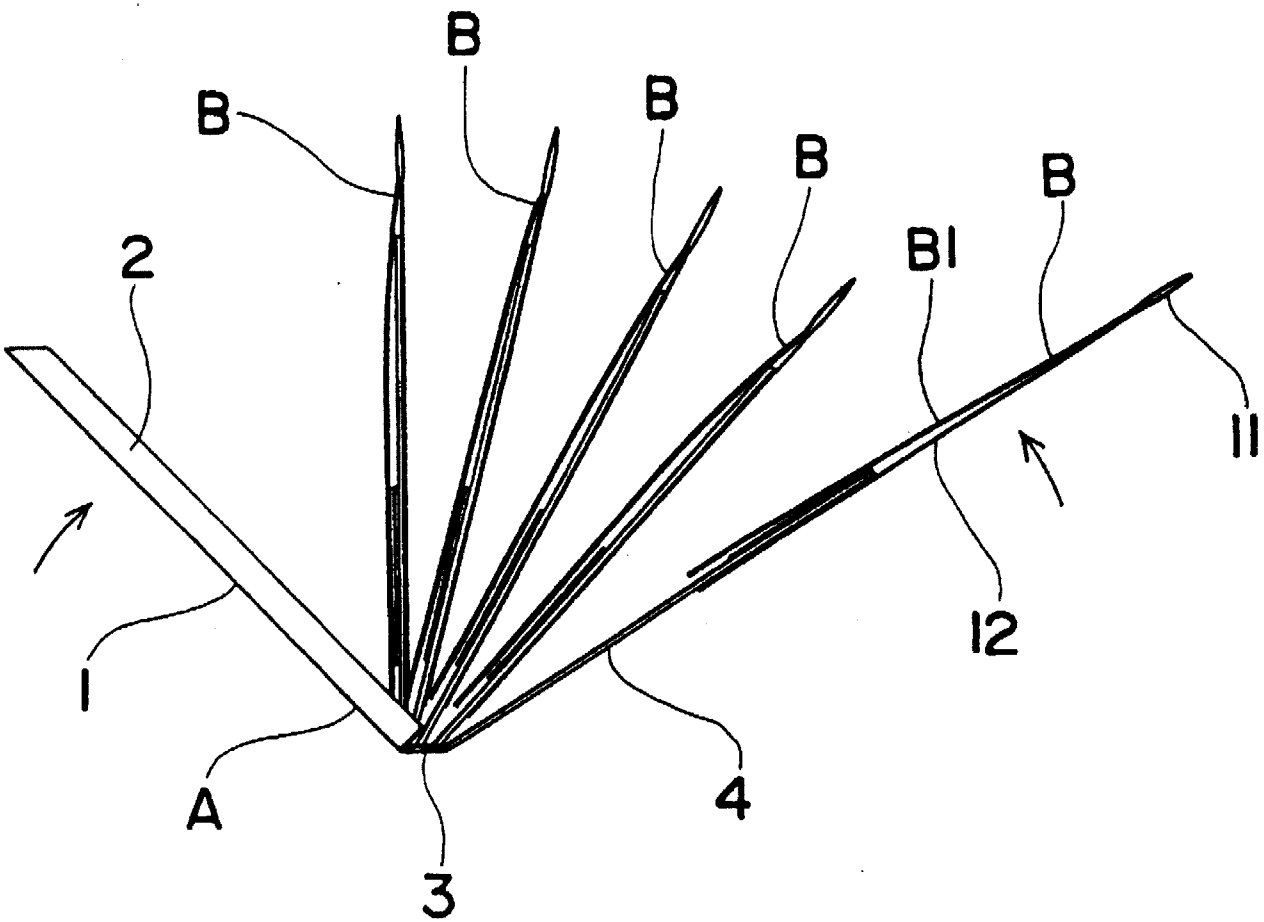
FIG. 2 is a side elevation view showing an embodiment of a card filing device according to the present invention.
Figure 3:
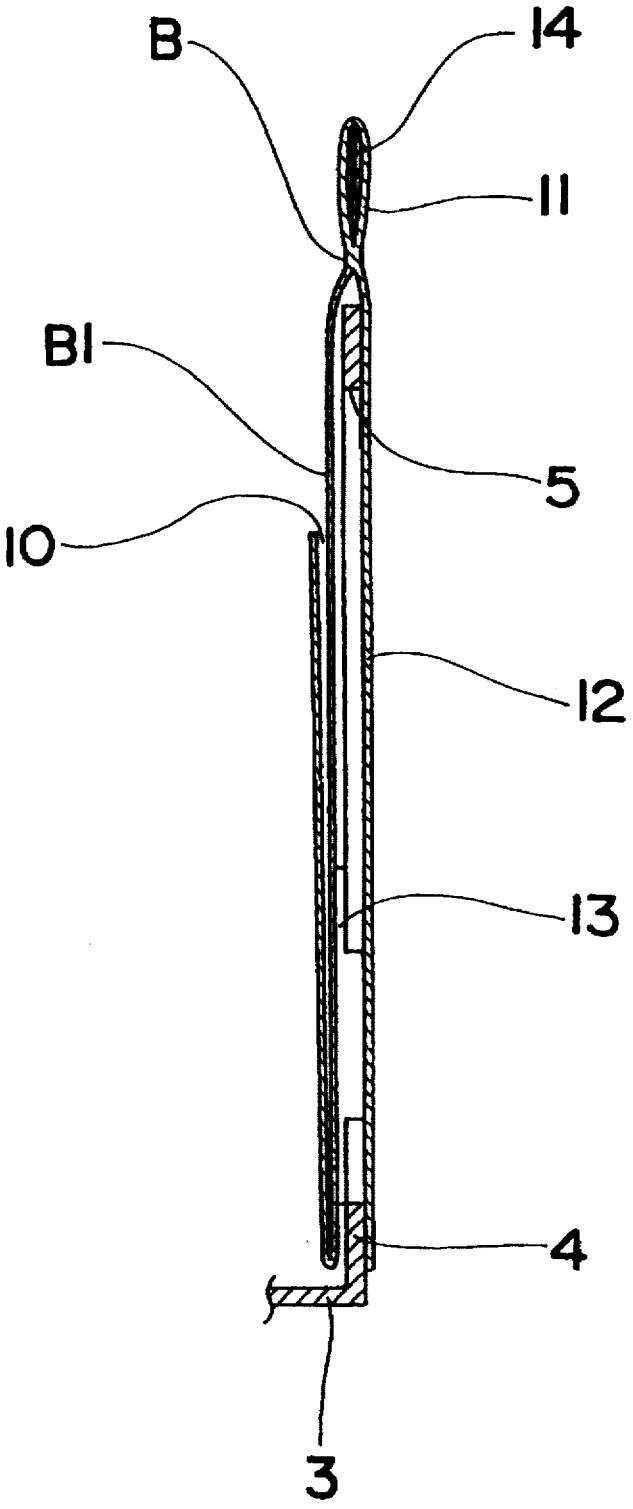
FIG. 3 is a partially enlarged side elevation view showing an embodiment of a card filing device according to the present invention.
Figure 4:
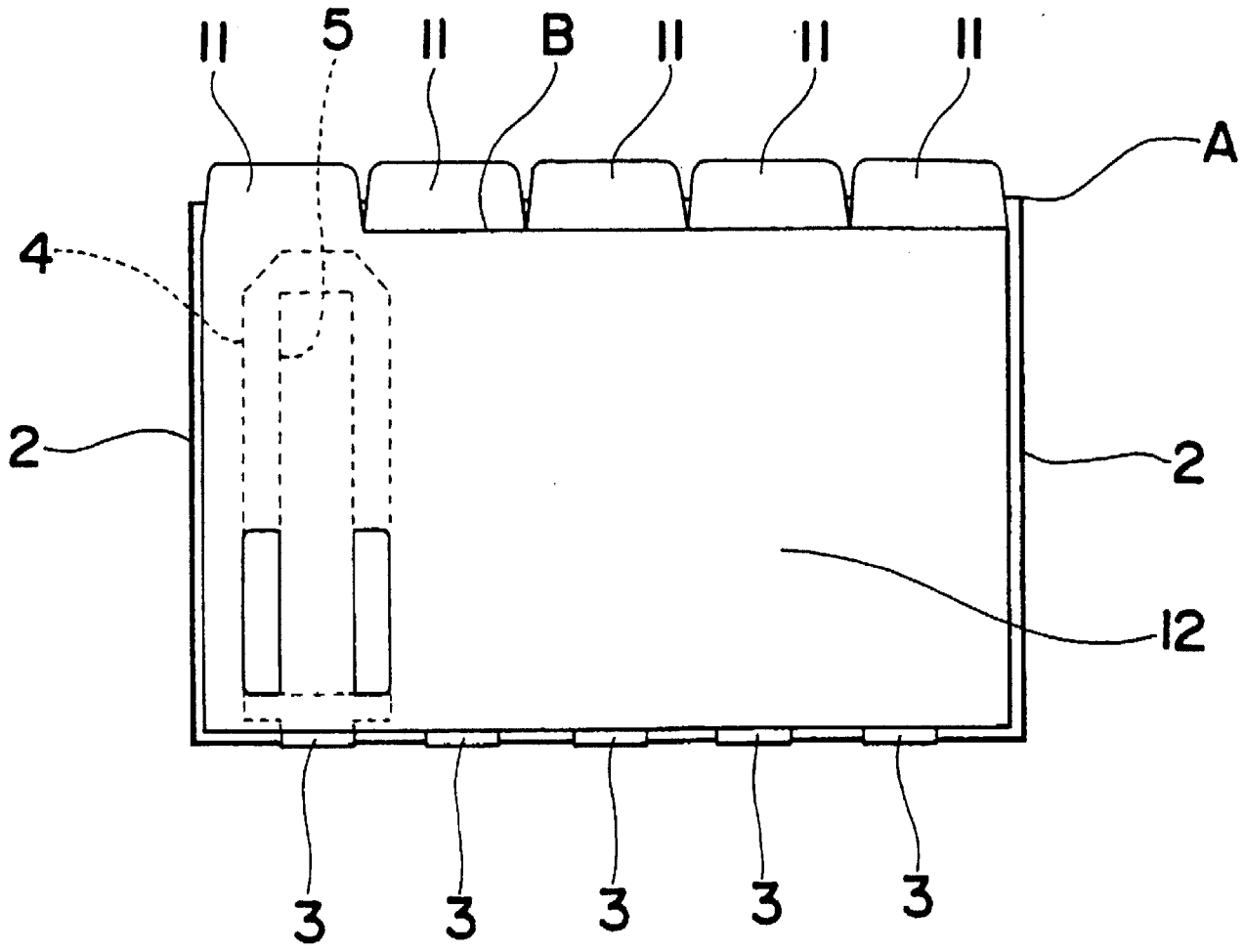
FIG. 4 is a rear elevation view showing an embodiment of a card filing device according to the present invention.

Hereinbelow, embodiments of the present invention will be explained.

The present invention is a card filing device which is capable of filing a plurality of rectangular (or other suitably shaped) cards such as credit cards, cash cards, telephone cards, other types debit cards, and ID cards, and allows these cards to be easily removed. This card filing device comprises a plurality (five in the example shown in the drawings) of card cases B having card storage pockets 10 which are capable of storing cards, and a holder A having a plurality of attachment leaves 4 to which the respective card cases B are attached such as to be capable of sliding in a predetermined direction (such as up and down).

Each card case B has a protruding tab portion 11 which is shaped such as to allow it to be easily grasped between the thumb and forefinger. When a selected card case B is grasped at the tab portion 11 and pulled so that the selected card case B slides with respect to the attachment leaf 4 of the holder A, the selected card case is made to protrude farther than the other card cases, thereby allowing a card contained in the selected card case B to be easily removed.

Another embodiment of a card filing device according to the present invention has a plurality of card cases B and a holder A as described above contained inside a storage portion 21 of a storage case C. When the tab portion 11 of a selected card case B is grasped by the fingers and pulled so that the selected card case B slides with respect to an attachment leaf 4 of the holder A, the selected card case B protrudes farther than the other card cases and protrudes from the storage portion 21 of the storage case C, thereby allowing a card contained in the selected card case B to be easily removed.

The holder A can be composed of synthetic resins, reinforced paper, other materials, or composites thereof. The holder comprises a rectangular base board 1 slightly larger than the stored cards, lateral leaves 2 respectively connected to the lateral ends of this base board 1 by means of fold lines, and a plurality of long roughly rectangular attachment leaves 4 which are connected to the base board 1 by means of coupling leaves 3 arranged with uniform spacing along the bottom end of the base board 1.

The base board 1 is provided in order to protect the front sides of the cards stored in the card cases B. The lateral leaves 2 are provided in order to protect the lateral edges of the cards stored in the card cases B. Additionally, the plurality of coupling leaves 3 may all be made to have the same length, or may be made sequentially longer so as to space the card cases B with a predetermined spacing and allow smooth movement of the card cases B.

Figure 5:
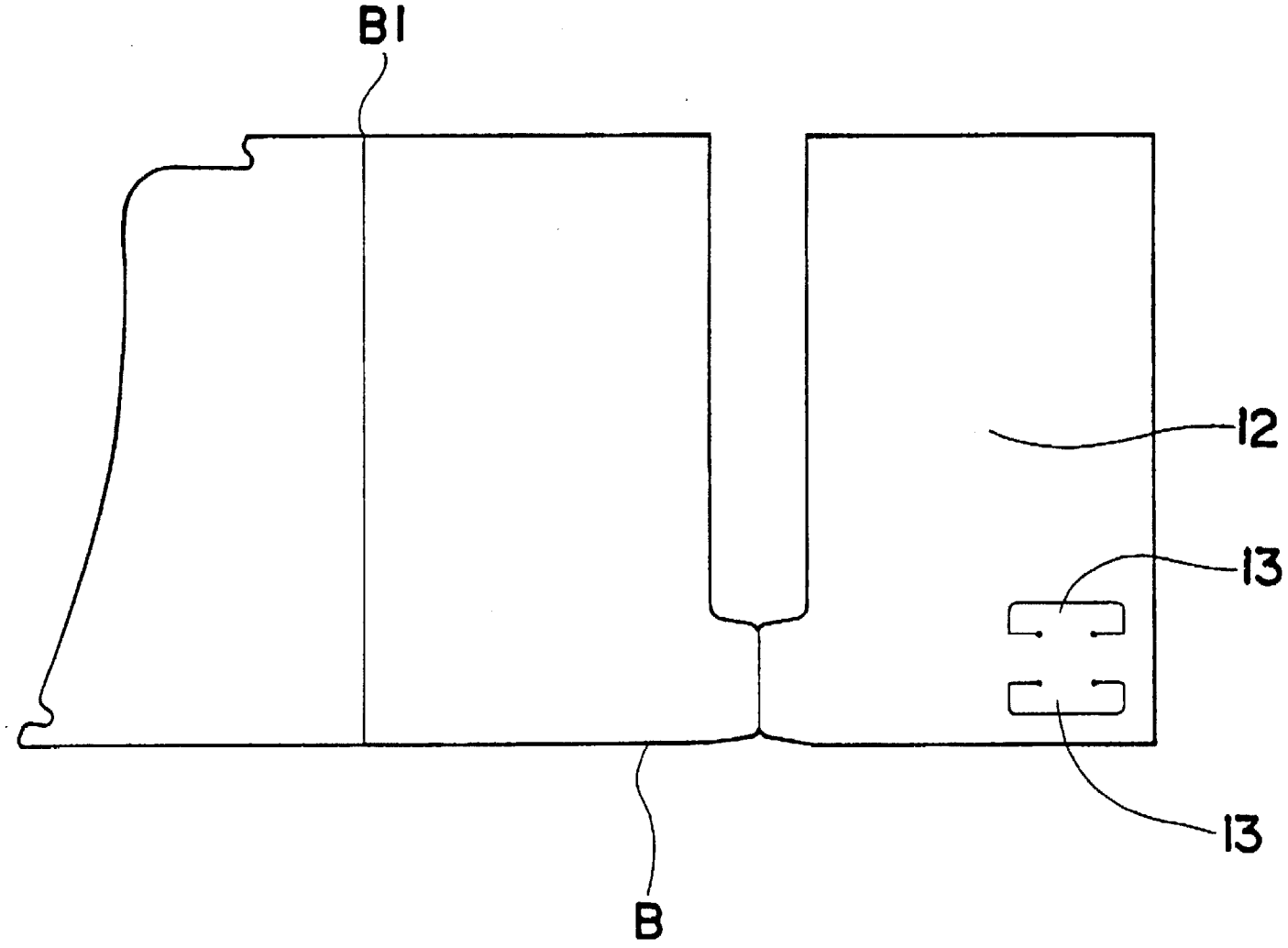
FIG. 5 is a spread-open view showing an embodiment of a card filing device according to the present invention.

The card cases B can be formed by appropriately fusing together thin, transparent (alternatively, semi-transparent or opaque) sheet materials (for example, see FIG. 5) formed from synthetic resins, reinforced paper, other materials, or composites thereof, containing anti-static agents. Each card case B comprises a rectangular card case body B1 having a card storage pocket 10 slightly larger than the cards to be stored, a rectangular covering leaf 12 connected at the top portion to the rear surface of the card case body B1, and a rectangular tab portion 11 protruding upward from the top portion of the card case body 1. The card case body B1 and the covering leaf 12 sandwich the attachment leaf 4 of the holder A, while an engagement portion 13 of the covering leaf 12 engages with a slide hole 5 provided in the attachment leaf 4, so as to allow the card case B to securely slide within a predetermined range in a predetermined direction (such as up and down) along the attachment leaf 4 of the holder A. Of course, the tab portions 11 on the card cases B are provided at staggered positions so as not to mutually overlap.

Furthermore, the engagement portion 13 provided on the covering leaf 12 of the card case B is positioned so as to be aligned with the tab portion 11 in the sliding direction of the card case B, so that the card case B will slide smoothly when the tab portion 11 is grasped by the fingers and pulled. Each tab portion 11 is formed so as to allow the insertion of a tab slip 14 by which the cards can be easily identified. As shown in the drawings, the engagement portion 13 can be formed by making a pair of opposing C-shaped cuts in the covering leaf 12, folding these upward and inserting them into the slide hole 5 of the attachment leaf 4, then hooking them over the edges of the slide hole 5 so that the engagement portion 13 will not easily come loose. Of course, the engagement portion 13 may be of any structure as long as it can reliably engage with the slide hole 5 of the attachment leaf 4 and can smoothly slide along the slide hole 5.

The storage case C can be formed from synthetic resin, reinforced paper, other materials, or composites thereof, and comprises a case body 20 having a storage portion 21 large enough to store the holder A and a plurality of card cases B, and a lid 23. By inserting an engagement leaf protruding from the lid 23 into an engagement hole 22 formed in the case body 20, the storage portion 21 of the case body 20 can be closed.

Of course, the embodiments given above are mere examples of possible structures for the present invention, so that other types of modifications are possible as long as they do not contradict the gist of the present invention.

The card filing device of the present invention has the above-described structure, and an example of the use of the present invention will be given below. First, the plurality of card cases B are attached to the attachment leaves 4 of the holder A by sandwiching each attachment leaf 4 of the holder A in between the covering leaf 12 and card case body B1 of a corresponding card case B, then the engagement portions 13 provided in the covering leaves 12 are engaged with the slide hole 5 of the attachment leaves 4 from the reverse side thereof. Then, the card cases B are stacked on top of the base board 1 of the holder A, and are stored in a wallet, or the storage portion 21 of a storage case C. Then, various types of cards can be put into the plurality of card cases, and tab slips 14 with headings corresponding to the respective cards can be inserted into the tab portions 11 of the card cases B. As a result, when a selected card is to be removed, the corresponding tab portion 11 is found, the tab portion 11 is grasped and pulled by the fingers to slide the selected card case B with respect to the attachment leaf 4, and made to protrude farther than the other card cases B, so as to allow the card to be easily removed.

I claim:

1. A card filing device, comprising:

a plurality of card cases each having a card storage pocket for storing cards and a tab portion which protrudes to allow grasping by a user's fingers; and a holder having a plurality of attachment leaves to which said plurality of card cases are respectively attached such as to be capable of sliding in a predetermined direction; wherein any desired card case can be pulled out to protrude further than the other card cases by sliding the desired card case with respect to the corresponding attachment leaf of said holder, so as to allow a card inside the card case to be easily removed.

2. A card filing device, comprising:

a plurality of card cases each having a card storage pocket for storing cards and a tab portion which protrudes to allow grasping by a user's fingers;

a holder having a plurality of attachment leaves to which said plurality of card cases are respectively attached such as to be capable of sliding in a predetermined direction; and a storage case for storing said holder and said plurality of cards; wherein any desired card case can be pulled out to protrude further than the other card cases and protrude from said storage case by sliding the desired card case with respect to the corresponding attachment leaf of said holder, so as to allow a card inside the card case to be easily removed.

3. A card filing device in accordance with claim 1, wherein each of said plurality of card cases comprises a card case body having said card storage pocket for storing cards and a covering leaf provided on a rear surface of said card case body, an attachment leaf of said holder is sandwiched between said card case body and said covering leaf, and an engagement portion of said covering leaf engages with a slide hole provided in the attachment leaf, so as to allow the card case to slide securely along the attachment leaf.

4. A card filing device in accordance with claim 2, wherein each of said plurality of card cases comprises a card case body having said card storage pocket for storing cards and a covering leaf provided on a rear surface of said card case body, an attachment leaf of said holder is sandwiched between said card case body and said covering leaf, and an engagement portion of said covering leaf engages with a slide hole provided in the attachment leaf, so as to allow the card case to slide securely along the attachment leaf.

5. A card filing device in accordance with claim 3, wherein the engagement portion of said covering leaf and the tab portion are aligned along the direction of sliding of the card case, so as to allow the card case to slide smoothly and easily along the attachment leaf when the tab portion is pulled by a user's fingers.

6. A card filing device in accordance with claim 4, wherein the engagement portion of said covering leaf and the tab portion are aligned along the direction of sliding of the card case, so as to allow the card case to slide smoothly and easily along the attachment leaf when the tab portion is pulled by a user's fingers.

* * * * *